US005979283A

United States Patent [19]

Osborne

[11] Patent Number: 5,979,283

[45] Date of Patent: Nov. 9, 1999

[54] MITER GUIDE

[76] Inventor: David H. Osborne, Bow 97, Montoursville, Pa. 17754

[21] Appl. No.: 08/925,712

[22] Filed: Sep. 9, 1997

Related U.S. Application Data

[60] Provisional application No. 60/032,699, Dec. 11, 1996.

[51] Int. Cl.[6] ..... B27B 27/06; B27B 25/10

[52] U.S. Cl. ..... 83/435.14; 83/435.12; 83/435.15; 83/477.2; 83/581; 33/459; 33/462

[58] Field of Search ..... 83/435.12, 435.13, 83/435.14, 435.15, 468, 468.3, 477.2, 581, 522.18; 33/461, 462, 459, 460, 463, 640, 641

[56] References Cited

U.S. PATENT DOCUMENTS

| | | | |
|---|---|---|---|
| 185,504 | 12/1876 | Devoe | 33/461 |
| 2,032,976 | 3/1936 | Carter | 83/435.12 |
| 2,193,793 | 3/1940 | Atherley | 33/459 |
| 2,895,515 | 7/1959 | Ende | 143/169 |
| 2,916,063 | 12/1959 | Boekenkamp | 144/136 |
| 2,926,706 | 3/1960 | Hopla | 83/522.18 |
| 2,968,325 | 1/1961 | Wandvik | 83/435.14 |
| 3,841,188 | 10/1974 | Wiater | 83/471.3 |
| 4,002,329 | 1/1977 | Petrowski | 269/318 |

(List continued on next page.)

FOREIGN PATENT DOCUMENTS

| | | | |
|---|---|---|---|
| 0011548 | 5/1980 | European Pat. Off. | 83/477.2 |

OTHER PUBLICATIONS

"Mitre Gauge & Clamp Attachment", Jun., 1997.
"Auto–Set® Miter Gage w/Clamp Attachment;" Model 34–895K, Jun. 1997.
"Hartville Exclusive"; Upgrade your saw from "standard" to "precision quality", Jun. 1997.
"Performance Miter Gage", Jun. 1997.
"Add an Accu–Miter. It may be better than getting a new saw", Jun. 1997.
"D/Accu–Miter Gauge", Jun. 1997.
"Adjustable Strap Miter Gauge", Jun. 1997.
"Miter Gauge with Holdown (and Adjustable Strap)", Jun. 1997.
"Quick Lock Miter Gauge With Adjustable Stop Rod", Jun. 1997.
"Clamping Miter Gauge", Model W1323, Jun. 1997.
"One squeeze locks word to this miter gauge for safe, accurate cuts", Jun. 1997.
"D/Fixed–Angle Mitre Guide", Jun. 1997.
"Table Bars for Making Your Own Jigs & Fixtures", Jun. 1997.
"Replacement Precision Table Bars for Your Delta & Sears Table Saws", Jun. 1997.
"Deluxe precision Mitre Guide", Jun. 1997.

*Primary Examiner*—M. Rachuba
*Assistant Examiner*—Stephen Choi
*Attorney, Agent, or Firm*—Sughure, Mion, Zinn, Macpeak & Seas, PLLC

[57] ABSTRACT

A miter guide for guiding a work piece along the cutting path of a saw blade or another working tool. The miter guide includes a guide bar which fits in a slot in the surface of a table, a fence for supporting the work piece, and a telescoping extension arm connected between the fence and the guide bar for fixing the position of the fence at a predetermined angle with respect to the plane of the saw blade. The fence is pivotally connected to the guide bar, and the telescoping extension arm is also pivotally connected to the guide bar, as well as being pivotally connected to the fence at an end of the fence remote from the guide bar. A broad based triangle is formed by the guide bar, the fence and the extension arm. The extension arm includes a rod that is slidably received in a tube, and a knob that is turned to push a deformable portion of the tube against the rod to fix a length of the extension arm, thereby setting the angle of the fence.

25 Claims, 5 Drawing Sheets

U.S. PATENT DOCUMENTS

| | | | |
|---|---|---|---|
| 4,202,233 | 5/1980 | Larson | 83/745 |
| 4,259,887 | 4/1981 | Dean | 83/437 |
| 4,300,426 | 11/1981 | Weaver | 83/471.3 |
| 4,317,562 | 3/1982 | Thibodaux | 269/304 |
| 4,328,728 | 5/1982 | Ferdinand et al. | 83/471.3 |
| 4,464,962 | 8/1984 | Myhre | 83/425 |
| 4,494,429 | 1/1985 | Frame | 83/435.1 |
| 4,593,590 | 6/1986 | Gray | 83/438 |
| 4,608,898 | 9/1986 | Volk | 83/745 |
| 4,741,387 | 5/1988 | Strong | 83/421 |
| 4,881,437 | 11/1989 | Macksoud | 83/477.2 |
| 4,884,604 | 12/1989 | Rice et al. | 144/84 |
| 4,892,021 | 1/1990 | Sanderson | 83/468 |
| 4,916,822 | 4/1990 | Johnson | 33/462 |
| 4,920,845 | 5/1990 | Blanchette | 83/574 |
| 4,974,306 | 12/1990 | Cole et al. | 83/477.2 |
| 5,016,508 | 5/1991 | Hallenbeck | 83/435.001 |
| 5,038,486 | 8/1991 | Ducate, Sr. | 33/430 |
| 5,042,346 | 8/1991 | McCann | 83/435.12 |
| 5,097,601 | 3/1992 | Pollak et al. | 83/435.14 |
| 5,205,198 | 4/1993 | Foray et al. | 83/435.001 |
| 5,297,463 | 3/1994 | O'Banion et al. | 83/458.3 |
| 5,379,669 | 1/1995 | Roedig | 83/421 |
| 5,402,581 | 4/1995 | Hurd et al. | 83/435.12 |
| 5,603,164 | 2/1997 | Haddix | 83/522.18 |
| 5,771,767 | 6/1998 | Itami | 83/435.13 |

MITER GUIDE

This appln claims the benefit of U.S. Provisional appln Ser. No. 60/032,699, Dec. 11, 1996.

BACKGROUND OF THE INVENTION

1. Field of the Invention

The present invention relates in general to an apparatus for accurately positioning a work piece in relation to a working tool, and more particularly to a miter guide for table saws or other cutting or shaping tools, such as those used in woodworking.

2. Description of the Related Art

Typical miter guides currently in use are comprised of a calibrated protractor fence which is pivotally attached to a steel bar. The protractor fence is usually an aluminum casting approximately 6 inches wide and 1¾ inches high. There is a blind pivot pin centered in its width attaching the casting to the guide bar and allowing the fence to rotate equally 45 degrees left and 45 degrees right, thereby changing the relative angle between the work piece and the cutting blade. Projecting vertically from the radiused protractor portion of the casting, there is a handle threaded into the steel guide bar that can be loosened to allow rotation of the fence and tightened to secure the fence in the desired angular orientation. Once the desired angle is selected and secured, the work piece is held tightly against the face of the casting. The casting is then manually moved forward in a straight line as the guide bar slides in the slot in the table top, thereby feeding the work piece into the plane of the cutting blade at the relative angle necessary to produce the desired cut. This configuration is universally typical in standard equipment miter guides which are included with the purchase of new woodworking table saws.

Some practical deficiencies in this approach to crosscutting a work piece are as follows. The surface area of the fence is proportionately too small to effectively stabilize the material being cut, consequently the material must be held very tightly against the face of the guide to counter the vibration that occurs when the work piece comes into contact with the rotating blade. Ultimately, this vibration causes slight lateral movement in the work piece, across the face of the guide, resulting in a finished cut that is not flat or true. This lack of fixed stability in the work piece can also increase the potential for the accidental kick-back of the work piece.

The danger of kick-back and potential for inconsistent cuts is so prevalent that many woodworkers modify the standard miter guide by attaching a longer, wider wooden face to the casting, thereby increasing the surface area against which the work piece can be secured. This is only moderately effective in resolving the problems. While the resulting increase in the surface area of the fence helps reduce the lateral movement caused by vibration, it also effectively creates a lever that works against the locking mechanism. The distance between the pivot point and the center of the tightening handle is often less than 3 inches. An extended face of only 12 or 14 inches can multiply the force against the locking handle and allow the gauge to slip. In addition, pushing or pulling the outermost end of the extension will invariably induce flexing, because the extension is only secured to the face of the casting. The outer end of the added piece is free to move as much as the material it is made of will allow. That is, even with the handle securely tightened, the outermost end of the wooden extension can flex sufficiently to compromise the integrity of the angle and of the face of the cut.

Still another deficiency in the current art is the method by which the desired angle is selected and secured. As the guide is rotated, a calibrated scale on the top face of the radiused portion of the casting passes beneath a stationary pointer. The increments (degrees) are indicated by raised or recessed lines. These lines are often foundry cast. The lines can be wide enough for the casting to move more than one half degree without taking the stationary pointer off the line, thereby compromising the accuracy of the setting.

In Macksound (U.S. Pat. No. 4,881,437), a longer fence is provided, and the outside end is stabilized with a diagonal bar. However, this design is self defeating due to the method of achieving variable angles. A three point configuration is used in an attempt to establish the desired stability inherent in a broad based triangle. However, as the fence is adjusted outward to a more acute angle, the movable arm that slides through the slot in the fence must move progressively closer to the plane of the cutting blade. When the device is set up to make a 45 degree cut, the three point base becomes very narrow. The outermost edge of the fence is no longer directly supported by the diagonal bar. This is the functional equivalent of a typical miter guide with an extension attached to the face. The outer end is free to flex and acts as a lever working against the locking mechanism that secures the device at a given angle.

In Frame (U.S. Pat. No. 4,494,429), an extended fence is added to the existing protractor type miter guide, and the outer end is stabilized with a stabilizing bar. Again, the intention was apparently to gain the benefit of the longer guide face and eliminate the problem of instability created by doing so. This approach is more effective than that of the previous example at keeping the end of the fence stationary. However, it is more elaborate and requires significant setup before it can be used. The process of changing angles for each different cut requires removing and replacing pins that fit into preset holes for specific angles. Additionally, when the device is set up to cut there are two guides that must move simultaneously to ensure accuracy. The mechanism has several links and adjustable contact points that would make it difficult to advance the entire assembly forward without one guide dragging or binding. It is not a device that is quick and easy to use.

The device disclosed by Hallenbeck (U.S. Pat. No. 5,016,508) maintains a wide based triangular configuration at any of the angles within its limited range. This ensures that at any setting the long fence is stable at both ends, and it significantly reduces the potential for deviation from the desired angular cut due to leverage against the locking mechanism or flexing. However, this device is cumbersome and involved. It requires a sliding table that covers the top of the saw. Its range of adjustment is limited. The fence starts out at a 90 degree cut and advances forwardly presumably to 45 degrees plus. There is no provision, however, for drawing the fence back to make cuts in the opposite direction. Any opposing cuts must be laid out on the back of the work piece and cut upside down. The main pivot at the end of the fence closest to the plane of the cutting blade is so far back toward the operator, that by the time the work piece has been fed completely through the cutting plane, the entire assembly is practically hanging off the far end of the table saw. Knobs and pins must be removed and replaced to change angles. With so many adjustments in different parts of the assembly, a little slop in each one cumulatively creates the potential for significant inaccuracy, in addition to the inconvenience of the set up process.

Each of the above described devices only work on one side of the saw blade and cannot be set up to feed from the other side. This is a disadvantage because the blade on some table saws adjusts angularly from 90 degrees (straight up) to 45 degrees left. Others adjust from 90 degrees to 45 degrees right. These designs are complicated to set up and limited in their usefulness.

SUMMARY OF THE INVENTION

An object of the present invention is to utilize a fundamentally more appropriate mechanical configuration to provide a broad based triangular miter guide that is more stable, more accurate, safer and simpler to use than the above described devices.

Another object of the present invention is to provide a miter guide that facilitates securing, orienting and feeding material, safely through the plane of the cutting blade.

These and other objects are accomplished by providing a miter guide for an apparatus which includes a working tool and a work table fixed relative to the working tool, the work table having a work surface with at least one alignment groove, the miter guide including:

a guide bar slidably received in the alignment groove;

a fence pivotally secured to the guide bar; and a telescoping extension arm pivotally secured to the guide bar at one end of the telescoping extension arm and pivotally secured to the fence at an opposite end of the telescoping extension arm.

The telescoping extension arm includes:

a rod pivotally connected to one of the fence and the guide bar; and a tube pivotally connected to the other one of the fence and said guide bar, wherein the rod is slidably received inside the tube.

A deformable portion of the tube can be pressed against the rod inside the tube and held in place to lock the extension arm at a predetermined length so that the fence is held at a desired angle with respect to the working tool.

The miter guide according to the present invention is inherently more secure and stable than the existing designs. A broad based triangle is formed by guide bar, the fence and the extension arm regardless of the position of the fence relative to the working tool. The fence provides a surface of contact with the work piece that is several times greater than the contact surfaces on existing miter guides.

The miter guide can be easily configured for safe and accurate use on the left or right sides of the working tool. The fence is easily reversed to allow primary use of a smooth face of the fence on one side of the fence, or an abrasive coated face on the opposite side of the fence (for plastic/nylon fences). Further, it can adjust forward and backward to at least 45 degrees in either direction. A detent mechanism can be used to auto locate the extension arm in a plurality of different predetermined commonly used positions corresponding to fixed angles of the fence.

The miter guide is at least as simple to remove, replace and use as the standard protractor type miter guide, yet reduces or eliminates all the problems associated with accuracy, safety and ease of use associated with the existing designs.

DETAILED DESCRIPTION OF THE PREFERRED EMBODIMENTS

Figure 1:
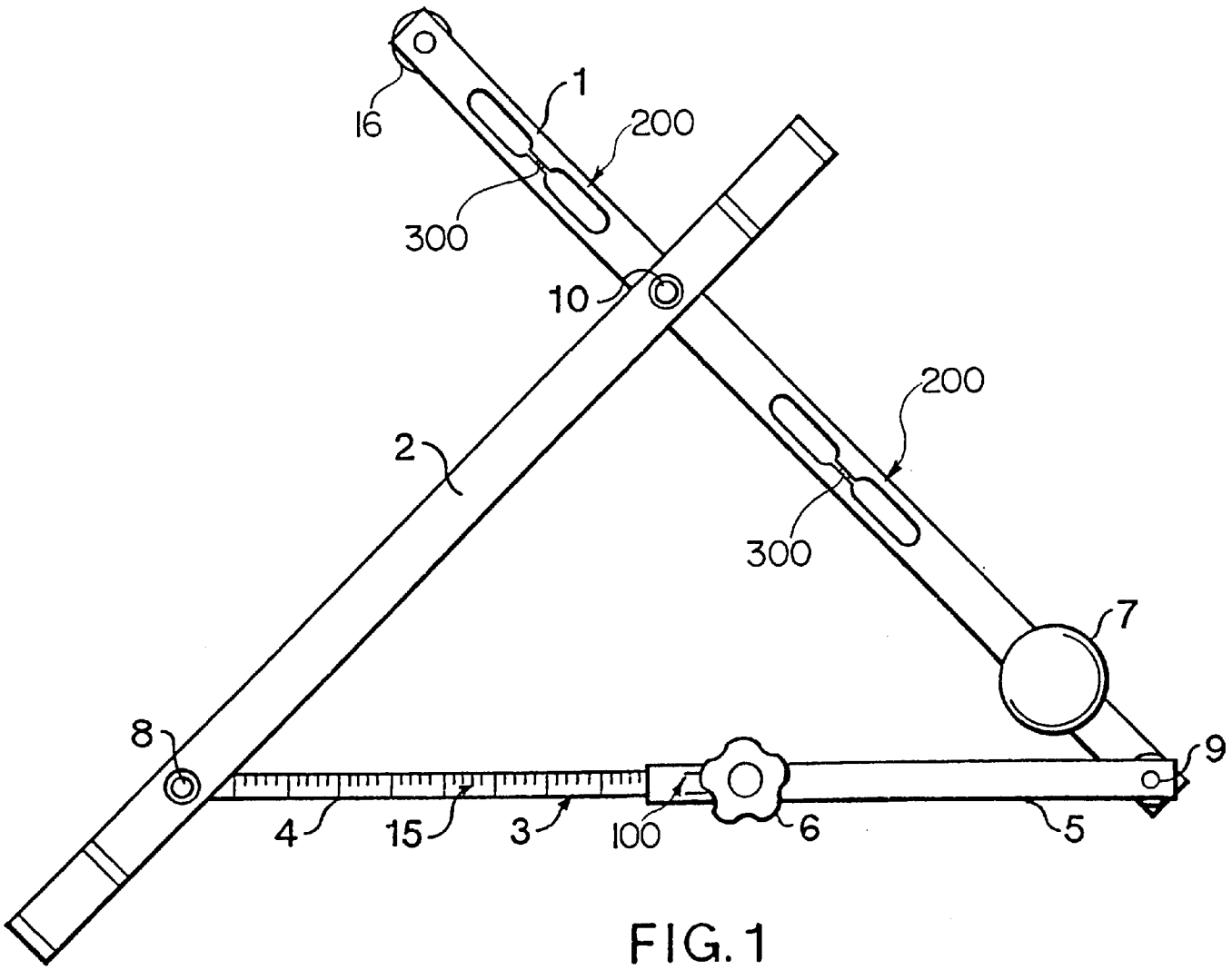
FIG. 1 is a plan view of a preferred embodiment of the miter guide of the present invention.

A preferred embodiment of the invention is described below with reference to the drawing figures. This preferred embodiment is described for use with a circular table saw. However, the miter guide of the present invention may also be used in combination with other work tools, such as for example band saws, jig saws, saber saws, dado heads, router tables, sanders, and shapers of various types. The miter guide of the present invention can be sized according to its application. For example, a small size miter guide would suit a router table, a medium size miter guide would suit a band saw, and a full size miter guide would suit a table saw. Sizes in between these sizes could also be used.

Figure 2:
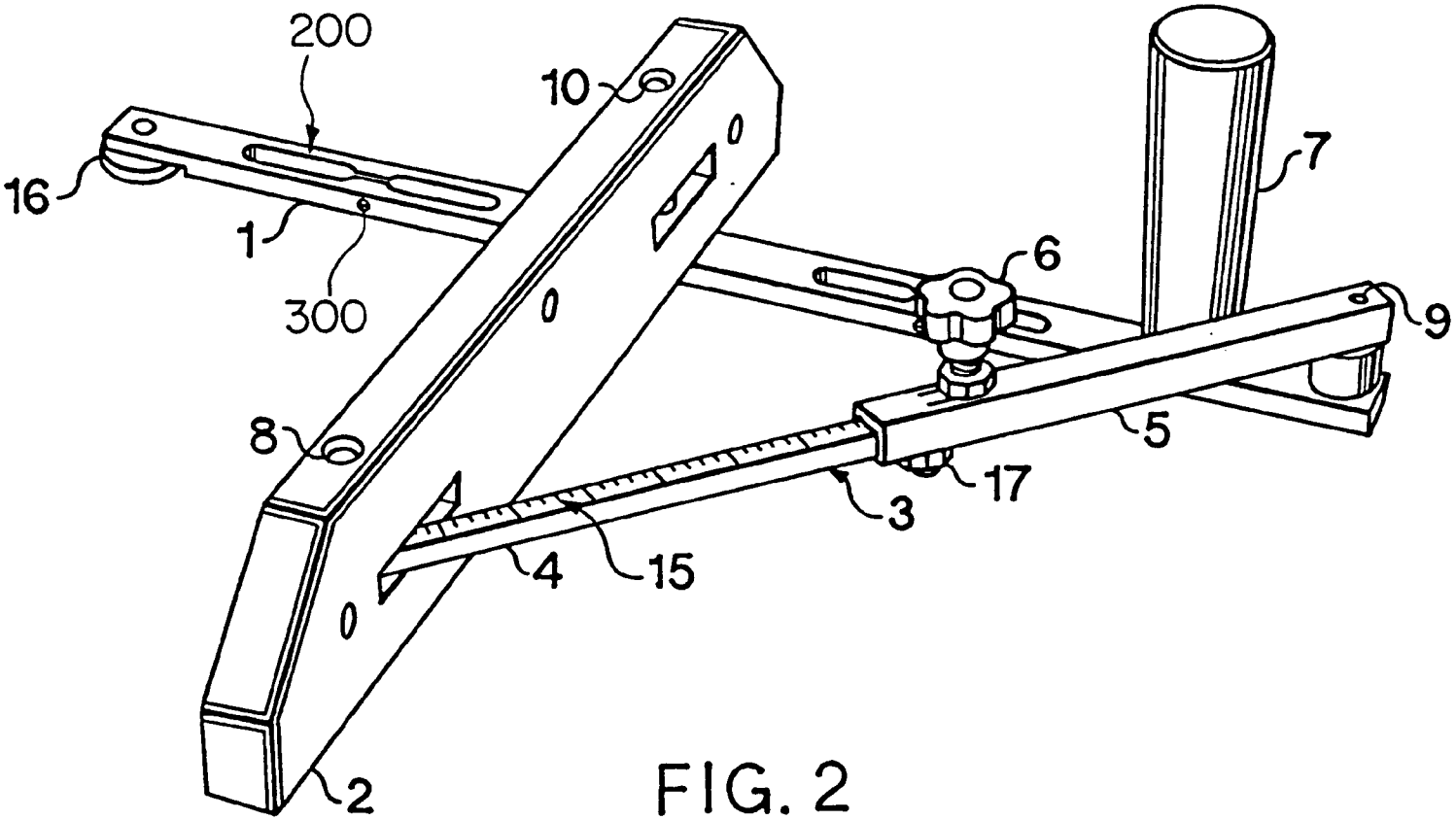
FIG. 2 is a perspective view of the miter guide shown in FIG. 1.

As shown in FIGS. 1 and 2, the miter guide includes a guide bar 1, a fence 2 and an extension arm 3. By way of example, the guide bar 1 may be made of steel, and the fence 2 may be formed as an iron casting and machined. In a preferred embodiment, the fence is made of ¾ inch DELRIN ACETAL which has been precision machined to the same tolerances specified for the iron casting. Alternatively, the fence may be made of nylon, urethane or any type of plastic material.

Figure 3:
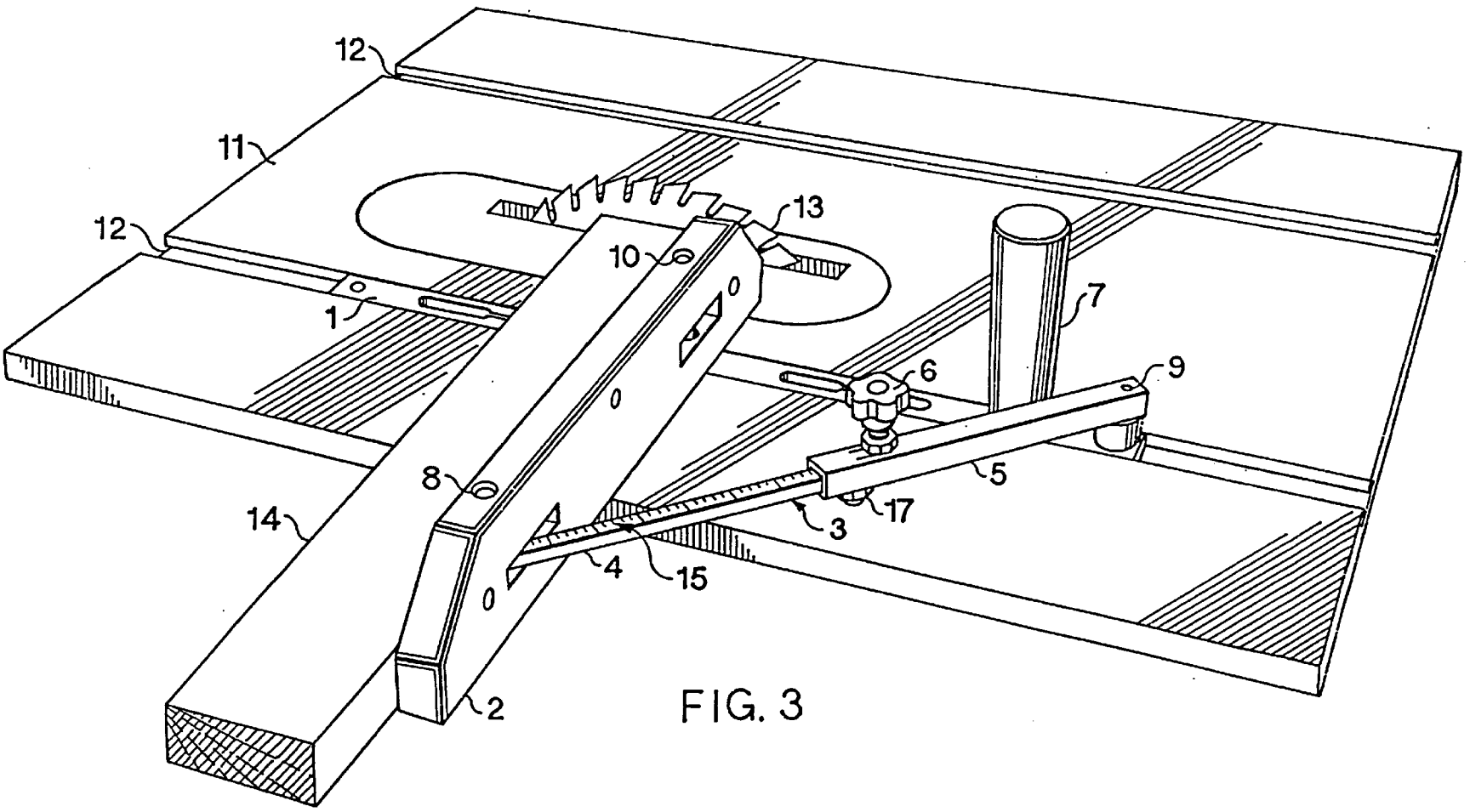
FIG. 3 is another perspective view of the miter guide in FIGS. 1 and 2, showing the miter guide being used with a circular table saw.

The fence 2 is preferably 15 inches long and 2½ inches high, although any suitable dimensions could be used. The fence 2 is pivotally attached at pivotal connection 10 to the guide bar 1. The guide bar 1 slides in a slot 12 (see FIG. 3) in the surface 11 of a table saw. The slot 12 extends parallel to the plane of the blade 13 of the table saw, so that the miter guide can be moved back and forth past the blade.

The guide bar 1 may be solid, or it may include two elongated openings 200 at forward and rear portions of the guide bar 1 for making the guide bar 1 adjustable in its width direction. The openings 200 are provided so that the guide bar 1 can be used with slots 12 having different widths (since not all tables have slots 12 that are the same width). Each opening 200 has an hourglass shape, i.e., it has two wider cut-out portions connected by a narrower middle cut-out portion. A threaded hole (not shown) is formed in the guide bar 1 on one side of the narrower middle cut-out portion, and a set screw 300 (see FIG. 2) is inserted into the threaded hole. When the set screw 300 is turned in one direction, the end of the set screw 300 inside the narrower middle cut-out portion abuts against the opposing surface of the narrower middle cut-out portion to expand the guide bar 1 in the width direction. When the screw is turned in the opposite direction, the guide bar 1 returns to its original width. The size and length of the openings 200 are such that they permit deflection without distortion, that is, the guide bar 1 can be expanded but it does not remain in that condition, i.e., it returns to its original shape (width) when the pressure created by the screw 300 is released. The positioning of the openings 200 at forward and rear portions of the guide bar 1 enables the operator to adjust the width of the bar in two places to attain an overall best fit condition.

The fence 2 is free to swing back and forth in a range of angles. The fence can be locked securely at any angle within this range by using the telescoping extension arm 3. The extension arm 3 is an assembly including a rod 4 that is slidably received in a tube 5. The rod 4 and tube 5 can have any cross-sectional shape, such as a square, a rectangle, a circle, an oval, a triangle, etc.

One end of the tube 5 is pivotally attached at pivotal connection 9 to the guide bar 1. One end of the rod 4 is pivotally attached at pivotal connection 8 to the fence 2. In FIG. 2, this end of the rod 4 is received in a hole formed in the fence 2, above the plane of the pivotal connection 10 between the guide bar 1 and the fence 2. As noted above, the opposite end of the rod 4 is slidably received in the tube 5. A broad based triangle is formed between the guide bar, the fence and the extension arm regardless of the position of the fence relative to the working tool. This significantly improves the stability of the miter guide at all angles of the fence relative to the workpiece.

Figure 5:
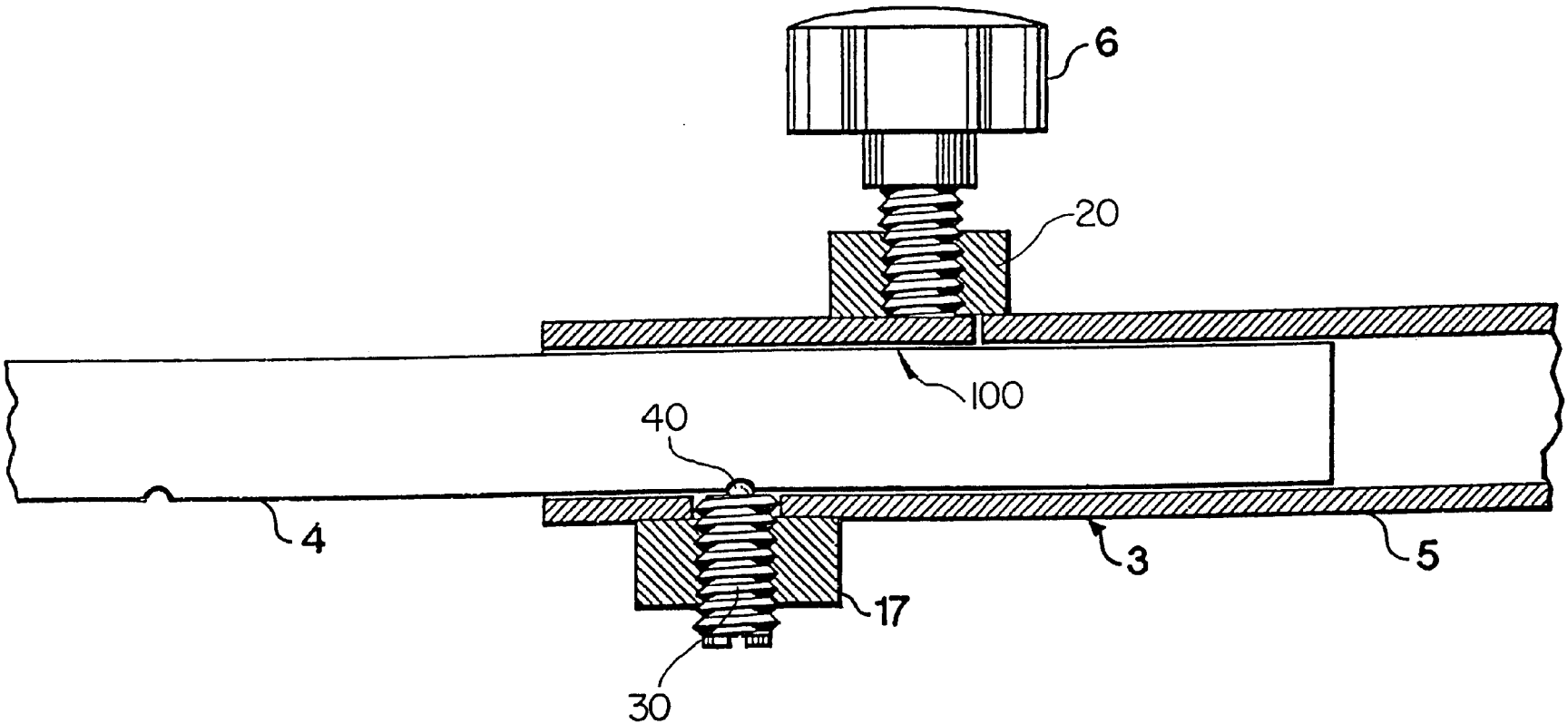
FIG. 5 is a cross-sectional view of a portion of the extension arm showing a locking device and a detent mechanism.

The locking mechanism for locking the rod 4 to the tube 5 is best shown in FIG. 5. A knob 6 has a male threaded portion that is threadably engaged with a female threaded member 20 fixedly secured to the tube 5 or formed unitarily therewith. The female threaded member 20 could be a nut or it could have any other external shape. The distal end of the male threaded portion presses a deformable portion 100 formed in the tube 5 against the rod 4, to fix by friction the position of the rod inside the tube 5.

The deformable portion 100 may take any shape as viewed from above the tube 5 (see FIG. 1), so long as it will yield enough (without losing its resilience) to be firmly pressed against the surface of the rod 4 when the knob 6 is turned. In the illustrated embodiment, the deformable portion resembles a flap defined by a U-shaped cut-out. The female threaded member 20 is secured to the tube 5 (e.g., by welding, adhesive, etc., or it can be formed unitarily therewith) in a position that does not prevent the cut-out portion 100 from flexing so as to enable the cut-out portion 100 to be pushed against the surface of the rod 4 when the knob 6 is turned.

Alternative constructions could involve, among others, using a threaded knob engaged in a threaded hole in the tube 5 (not shown), so that the threaded knob can be tightened to pin the rod 4 against the inside wall of the tube 5, or a cam (also not shown) that is rotatably supported on the tube 5 and bears against the rod 4 to hold the rod 4 in position.

Another female threaded member 17 is secured to the bottom of tube 5 or formed unitarily therewith, and offset along the length of the tube from the cutout portion 100. The female threaded member 17 could be a nut or it could have any external shape. A male threaded piece 30 is threadably engaged in the female threaded member 17 and has a slot on its lower end so that a screwdriver can be used to adjust its position. The upper end of the male threaded piece 30 carries a spring (not shown) and ball bearing or plunger 40. The ball bearing or plunger is pressed against the lower surface of the rod 4 by the spring, and the rod 4 has small indentations in its lower surface that correspond to predetermined angles of the fence 2 with respect to the guide bar 1. The ball bearing and the indentations enable the operator to click the fence 2 into precise position with a minimum of guess work. Of course, this is not a necessary feature.

The face of the fence 2 may have an abrasive surface (not shown) for preventing transverse movement of the work piece across the contact surface of the fence.

A handle 7 projects upwardly from the guide bar 1, enabling the operator to control the force and rate of feed with one hand, while positively securing the work piece against the fence 2 with the other hand. The handle 7 could be formed in front of, or behind, the pivotal connection 9 between the tube 5 and the guide bar 1. Positioning the handle 7 behind the pivotal connection would require a longer guide bar than that shown. When the fence is an iron casting, the cutting procedure is further enhanced by the mass of the iron casting which adds to the stability of the cutting process and uniformity of the feed rate.

A calibrated scale 15 (FIG. 1) indicating degrees of angle relative to the cutting plane is visible on the top of the rod 4. The angle is read where the rod 4 disappears into the tube 5. Adjusting for different angles is easily achieved by turning the knob 6 counterclockwise, swinging the fence 2 to the desired angle, and then turning the knob 6 clockwise to press the cut-out portion 100 of the tube 5 against the rod 4.

Figure 4:
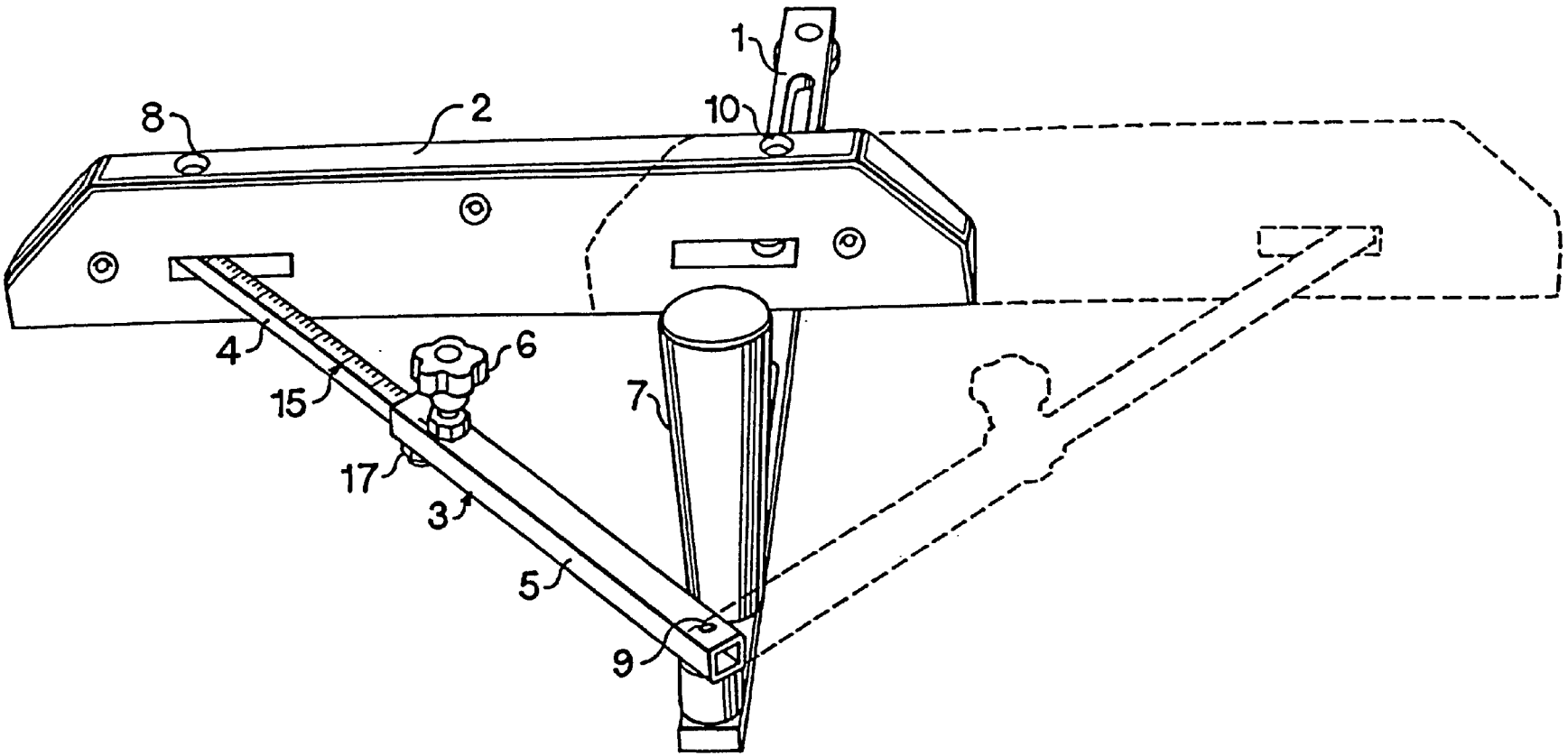
FIG. 4 is a perspective view of the miter guide in FIGS. 1–3, including dotted lines showing the miter guide as arranged for use on an opposite side of the working tool.

A significant additional advantage of the new miter guide is that it can easily be configured for safe and accurate use on the left or right sides of the saw blade 13, as shown by the solid and dotted lines, respectively, in FIG. 4. When the fence is a cast iron fence and therefore only one side of the fence can be used to guide the workpiece, the fence can be moved to the opposite side of the guide bar simply by switching the pivotal connection between the fence 2 and guide bar 1 with the pivotal connection between the fence 2 and the extension arm 3 (and swinging the extension arm 3 over to the other side of the guide bar). The guide bar 1 can then be placed in the opposite slot 12 in the table top on the other side of the saw blade 13. When the fence is a plastic/nylon fence, the user simply loosens the bolt at pivotal connection 8 to release the end of the telescoping extension arm, pivots the fence 2 and the extension arm 3 over to the other side of the guide bar 1, and resecures the bolt at pivotal connection 8. In both instances, calibration is concentric and remains accurate.

The miter guide of the present invention has an added advantage over the existing designs in that it is adjustable forward and backward to 45 degrees plus in either direction.

In order to minimize slop, the pivotal connections 8–10 between the fence 2, the guide bar 1 and the extension arm 3 may be made with shoulder bolts and pivot bores (not shown) that are machined to tolerances of plus or minus 0.0025 inches.

If the alignment slot 12 in the work table has "T" shaped cross-section, then the guide bar can include an increased width portion (such as created by a washer 16 secured to the guide bar—see FIGS. 1, 2 and 4) for holding the guide bar in the alignment slot.

Cuts produced in the work piece are consistently smooth, square and true. Engagement with the cutting blade is positive, controlled and safe. Lateral movement of the workpiece is eliminated. The miter guide of the present invention is at least as simple to remove, replace and use as the standard protractor type miter guide, yet reduces or eliminates all the problems associated with accuracy, safety and ease of use.

While preferred embodiments of the invention have been shown by way of example in the drawings, it will be understood that the invention is not intended to be limited to these embodiments.

What is claimed is:

1. In a table saw which includes a cutting blade and a work table having a work surface with at least one alignment groove extending substantially parallel to said cutting blade, the improvement comprising a miter guide which includes:

a guide bar slidably received in the alignment groove;

a fence pivotally secured to said guide bar for angularly positioning a workpiece with respect to the cutting blade; and a telescoping extension arm pivotally secured to said guide bar at one end of said telescoping extension arm and pivotally secured to said fence at an opposite end of said telescoping extension arm, wherein an angle between said fence and said guide bar, and attendantly between said fence and said cutting blade, is adjustable by adjusting said telescopic extension arm.

2. The table saw of claim 1, further comprising a handle rigidly connected to said guide bar.

3. The table saw of claim 1, wherein the alignment groove has an inverted "T" shape, and wherein said guide bar comprises an increased width portion for retaining said guide bar in the alignment groove.

4. The table saw of claim 3, wherein said increased width portion of said guide bar comprises a washer secured to a bottom surface of said guide bar.

5. A table saw of claim 1, wherein said telescoping extension arm comprises:

a rod pivotally connected to a first one of said fence and said guide bar; and a tube pivotally connected to a second one of said fence and said guide bar, wherein said rod is slidably received inside said tube.

6. The table saw of claim 5, further comprising:

a knob;

a male threaded member fixed to said knob;

a female threaded member secured to said tube, said male threaded member being threadably engaged with said female threaded member; and a deformable portion in said tube, said deformable portion being disposed below a distal end of said male threaded member, wherein when said knob is turned in one direction, said distal end of said male threaded member is pressed against said deformable portion to push said deformable portion against said rod in order to fix relative positions of said rod and said tube, and wherein when said knob is turned in an opposite direction, said distal end of said male threaded member is moved away from said deformable portion so that said deformable portion is moved out of contact with said rod and said rod and said tube are free to move relative to each other.

7. The table saw of claim 6, further comprising:

another female threaded member secured to said rod;

another male threaded member threadably engaged in said another female threaded member;

a spring and one of a ball bearing and a plunger provided on an end of said another male threaded member, said one of said ball bearing and said plunger being pressed against said rod by said spring, wherein said rod has indentations at predetermined intervals along its length which correspond to predetermined angles between said fence and a workpiece, said one of said ball bearing and said plunger being received in the indentations.

8. The table saw of claim 7, wherein said another male threaded member has a slot in an end opposite said end on which said spring and said one of said ball bearing and said plunger are provided, said slot having a size and shape to receive a tool for turning said another male threaded member to adjust a position of said spring and said one of said ball bearing and said plunger with respect to said rod.

9. The table saw of claim 5, wherein said rod and said tube are both square in cross section.

10. The table saw of claim 5, wherein said rod has a calibrated scale for determining an angle of said fence relative to the working tool.

11. The table saw of claim 1, wherein said fence has a hole, and wherein an end of said telescoping extension arm is pivotally mounted in said hole.

12. The table saw of claim 11, wherein said hole is an elongated through hole in said fence.

13. The table saw of claim 1, wherein said fence is made of nylon.

14. The table saw of claim 1, wherein said fence is made of plastic.

15. The table saw of claim 1, wherein said fence is made of cast iron.

16. The table saw of claim 1, wherein said guide bar is made of steel.

17. The table saw of claim 1, wherein pivotal connections between said guide bar, said fence and said extension arm each comprise shoulder bolts inserted in pivot bores.

18. The table saw of claim 1, wherein said fence has an abrasive surface that contacts a work piece to hold the work piece with respect to said fence.

19. In a table saw which includes a cutting tool and a work table having a work surface with at least one alignment slot therein, the improvement comprising a miter guide which includes:

a guide bar that fits in said alignment slot;

an elongated fence pivotally connected to said guide bar; and an adjustable extension arm pivotally connected to said guide bar and to said elongated fence for setting an angle of said fence with respect to the cutting tool.

20. The table saw of claim 19, wherein said extension arm is pivotally connected to said fence at an end of said fence that is remote from said guide bar.

21. The table saw of claim 19, wherein said guide bar, said fence and said extension arm form a broad-based triangle regardless of the angle of said fence with respect to the cutting tool.

22. The table saw of claim 19, wherein said fence is reversible so as to enable said fence to be pivotally connected to said guide bar and extend to either side of said guide bar.

23. The table saw of claim 19, wherein said guide bar is adjustable in a width direction of said guide bar.

24. The table saw of claim 23, wherein said guide bar comprises at least one opening having two wider cut-out portions separated by a narrower middle cut-out portion, and a threaded hole on one side of said narrower middle cut-out portion, a set screw being received in said threaded hole for adjusting the width of the said guide bar by spreading said guide bar at said at least one opening.

25. A table saw, comprising:

a cutting tool;

a work table having a work surface for supporting a workpiece, the work surface having at least one alignment groove therein;

a guide bar slidably received in the alignment groove;

a fence pivotally secured to said guide bar for angularly positioning a workpiece with respect to the cutting tool; and a telescoping extension arm pivotally secured to said guide bar at one end of said telescoping extension arm and pivotally secured to said fence at an opposite end of said telescoping extension arm, wherein an angle between said fence and said guide bar, and attendantly between said fence and said cutting tool, is adjustable by adjusting said telescopic extension arm.

* * * * *